United States Patent [19]

Wettlaufer

[11] 4,191,103

[45] Mar. 4, 1980

[54] APPARATUS FOR EXTRACTING JUICE FROM POMACE

[75] Inventor: Dale E. Wettlaufer, East Aurora, N.Y.

[73] Assignee: Terrier Machine Corporation, Buffalo, N.Y.

[21] Appl. No.: 823,221

[22] Filed: Aug. 10, 1977

[51] Int. Cl.[2] ..... B30B 9/06

[52] U.S. Cl. ..... 100/110; 100/120; 100/123; 100/156; 100/177; 100/210; 198/630

[58] Field of Search ..... 100/118–123, 100/144, 151–154, 156, 210, 211, 110; 210/386, 400, 401, 350, 351; 417/417, 416, 415; 198/630, 721, 717, 725, 728

[56] References Cited

U.S. PATENT DOCUMENTS

| | | | |
|---|---|---|---|
| 555,429 | 2/1896 | Cline et al. | 100/120 X |
| 675,776 | 6/1901 | Grimes | 100/120 X |
| 1,600,882 | 9/1926 | Jacobson | 100/177 X |
| 2,121,932 | 6/1938 | Slocum | 100/177 |
| 2,497,532 | 2/1950 | Berkman | 417/477 X |
| 3,279,357 | 10/1966 | Farmer | 100/177 X |

FOREIGN PATENT DOCUMENTS

| | | | |
|---|---|---|---|
| 926777 | 4/1955 | Fed. Rep. of Germany | 198/630 |
| 38074 | 4/1965 | German Democratic Rep. | 100/120 |
| 40184 | 3/1907 | Switzerland | 100/123 |
| 689486 | 3/1953 | United Kingdom | 198/630 |

*Primary Examiner*—Peter Feldman

[57] ABSTRACT

An improved juice extractor is adapted to separate the juice of a fruit pomace from the pulp thereof. The juice extractor has an elongated flexible open-ended sleeve positioned adjacent a bearing or backup surface, and having an entrance end adapted to receive the pomace. The sleeve is formed of a foraminous material permeable to the juice to be extracted, but substantially impermeable to the pulp of such fruit. The cross-sectional area of this sleeve decreases toward its exit end. A plurality of roller members are adapted to press proximate portions of the sleeve against the bearing surface, and are also mounted for movement along the sleeve. The action of the moving roller members causes the pomace to be advanced along the sleeve. Such movement of the roller members, coupled with the decreasing cross-sectional area of the sleeve, gently squeezes the pomace to separate the juice from the pulp. The juice passes through the sleeve and is collected. The pulp is discharged through the exit end of the sleeve.

11 Claims, 12 Drawing Figures

Fig. 1.
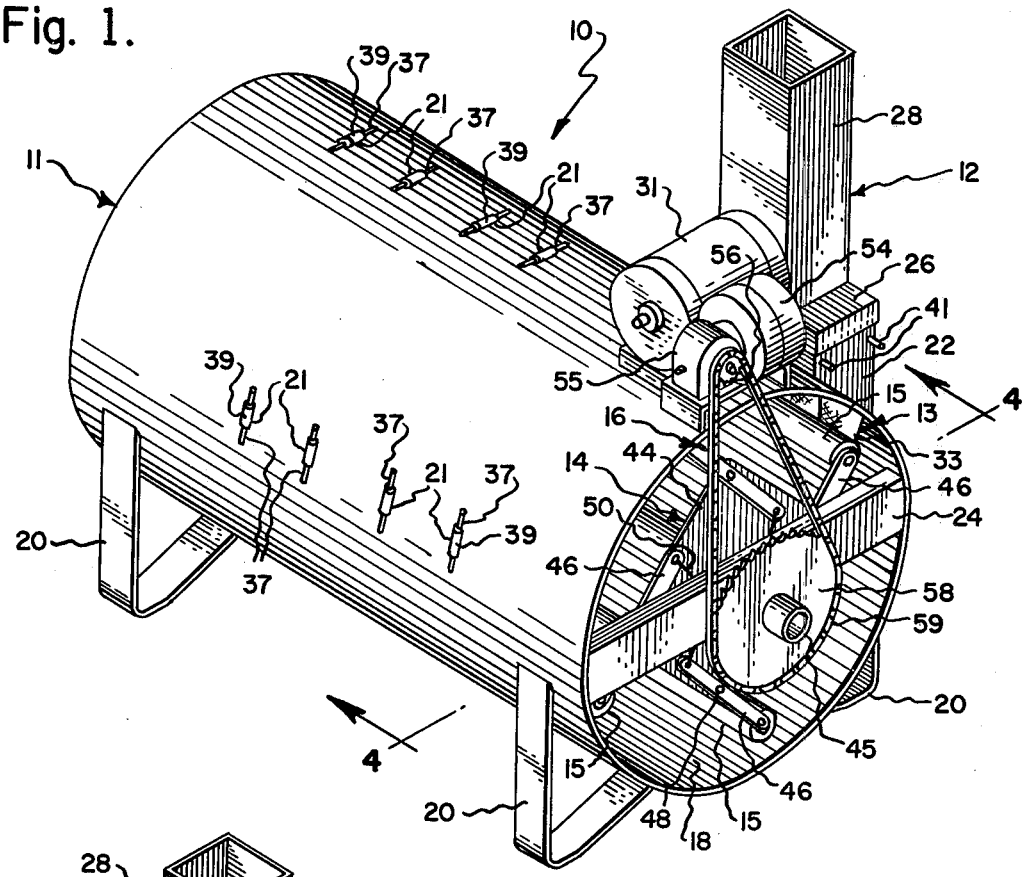
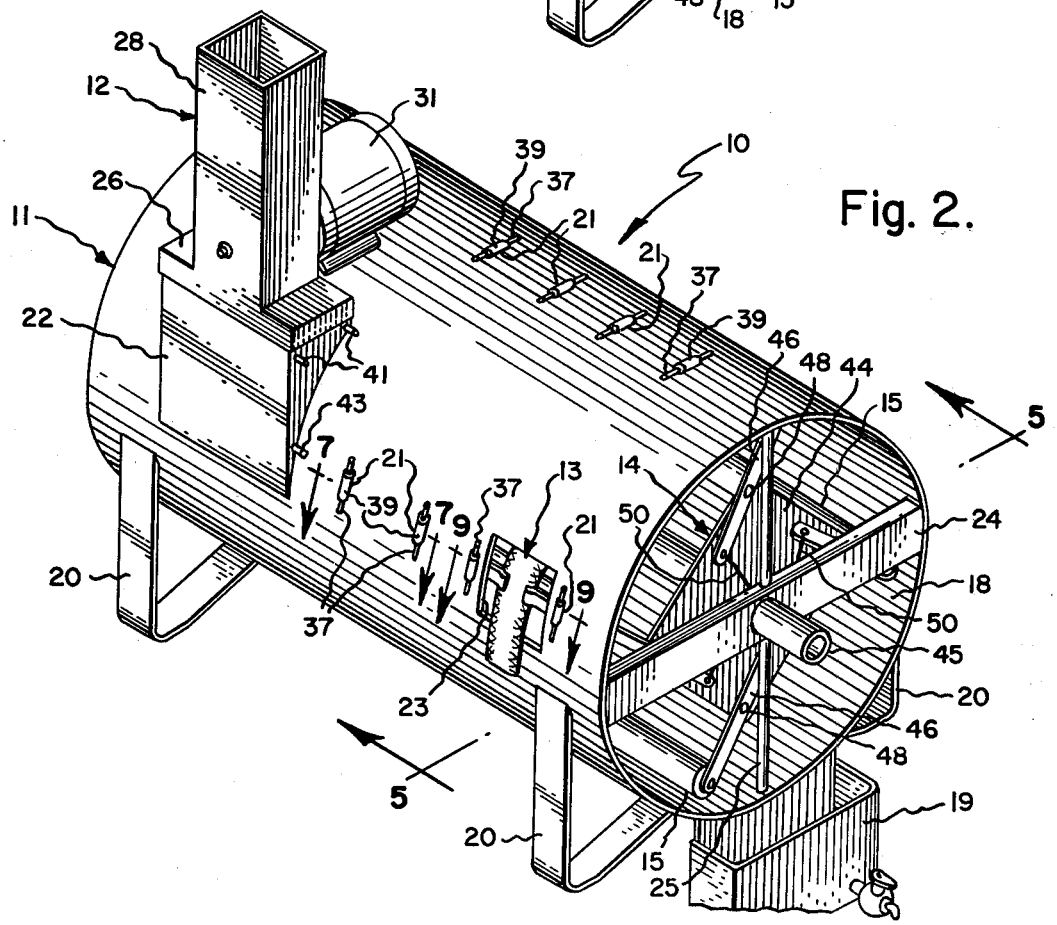
Fig. 2.

APPARATUS FOR EXTRACTING JUICE FROM POMACE

BACKGROUND OF THE INVENTION

1. Field of the Invention

The present invention relates generally to apparatus for separating juice from the pulp of a fruit pomace, and more particularly to an improved juice extractor which may be operated continuously rather than intermittently.

2. Description of the Prior Art

Upon information and belief, the most common type of juice extractor is a press having a platen which may be moved to squeeze fruit against a plate surrounded by a perforated screen and forcibly extract the juice from its pulp. However, such presses are normally operated on an intermittent batch basis, rather than on a continuous basis. Also, because such presses are capable of exerting a great force, high stress levels are developed in the screen, and it is not uncommon for the juice to be clouded with suspended solid particles of the pulp, requiring a subsequent filtration operation to remove or reduce such solids.

SUMMARY OF THE INVENTION

The present invention provides an improved juice extractor which is adapted to separate the juice from the pulp of a fruit pomace.

The improved juice extractor broadly includes a bearing or backup member having a bearing surface, an elongated flexible sleeve positioned adjacent the bearing surface, at least one roller member mounted for movement relative to the sleeve and arranged to press a proximate portion of the sleeve against the bearing surface, and drive means operatively arranged to move the roller member relative to the sleeve to advance the contents therealong.

The sleeve preferably has open entrance and exit ends, and is constructed of a foraminous material which is permeable to the juice but substantially impermeable to the pulp. The cross-sectional area of the sleeve preferably decreases, either in steps or in a continuous taper, toward the exit end. Preferably, the foraminous sleeve is relatively elastic in a transverse direction, but relatively inelastic in its longitudinal direction.

The pressing action of the roller member, together with the decreasing cross-sectional area of the sleeve, combine to impart a gentle squeezing action to the pomace while the pulp is advanced along the sleeve. The juice passes through the sleeve and is collected. The pulp is discharged from the exit end of the sleeve.

The roller members may be spring biased into such pressing engagement with the sleeve. In this form, the tension on the springs may be adjusted so as to vary the force with which each roller member engages the sleeve.

In one embodiment, the bearing or backup member is a cylindrical shell or drum to provide an internal bearing surface, and the length of the sleeve is consumed in approximately two convolutions of the bearing surface. In this form, a plurality of roller members are mounted on a rotor arranged within the bearing member.

In another embodiment, the bearing or backup member is a flat plate arranged substantially horizontal to provide a flat bearing surface having a plurality of perforations through which extracted juice may pass. In this form, the sleeve is maintained substantially linearly over the bearing surface, and a plurality of roller members biased toward this surface are caused to move relative to the sleeve to advance the contents therealong.

In use, the apparatus performs a novel method of separating the juice of a pomace from the pulp thereof, which method comprises the steps of: supplying pomace to the entrance end of the sleeve, holding the sleeve adjacent the bearing surface, pressing at least one roller member against the sleeve to compress a proximate portion thereof between the roller member and the bearing surface, and moving the roller member along the sleeve to advance the contents thereof toward its exit end. The decreasing cross-sectional area of the sleeve, coupled with the transverse elasticity of the sleeve where utilized, and the pressing action of the roller member cause the pomace to be gently squeezed to extract the juice therefrom while the pulp is advanced along the sleeve and ultimately discharged.

Accordingly, one general object of the present invention is to provide improved apparatus which may be used to separate juice from the pulp of a pomace.

Another object is to provide an improved juice extractor which may be operated continuously, rather than intermittently.

Another object is to provide an improved juice extractor wherein the pomace is subjected to a progressive gentle squeezing action.

Another object is to provide improved apparatus capable of extracting juice of high clarity.

These and other objects and advantages will become apparent from the foregoing and ongoing written specification, the drawings, and the appended claims.

BRIEF DESCRIPTION OF THE DRAWINGS

FIG. 1 is a perspective view of the right front end of a first preferred embodiment of the improved juice extractor, this view showing the bearing member, the grinder, and the drive means arranged to rotate the rotor.

FIG. 2 is a perspective view of the left rear end thereof showing the entrance conduit through which juicy pomace is delivered from the grinder to the sleeve, showing the exit end of the sleeve as passing through the bearing member discharge opening, and showing the collecting tank 19 arranged to receive a flow of extracted juice.

DESCRIPTION OF THE PREFERRED EMBODIMENTS

Figure 3:
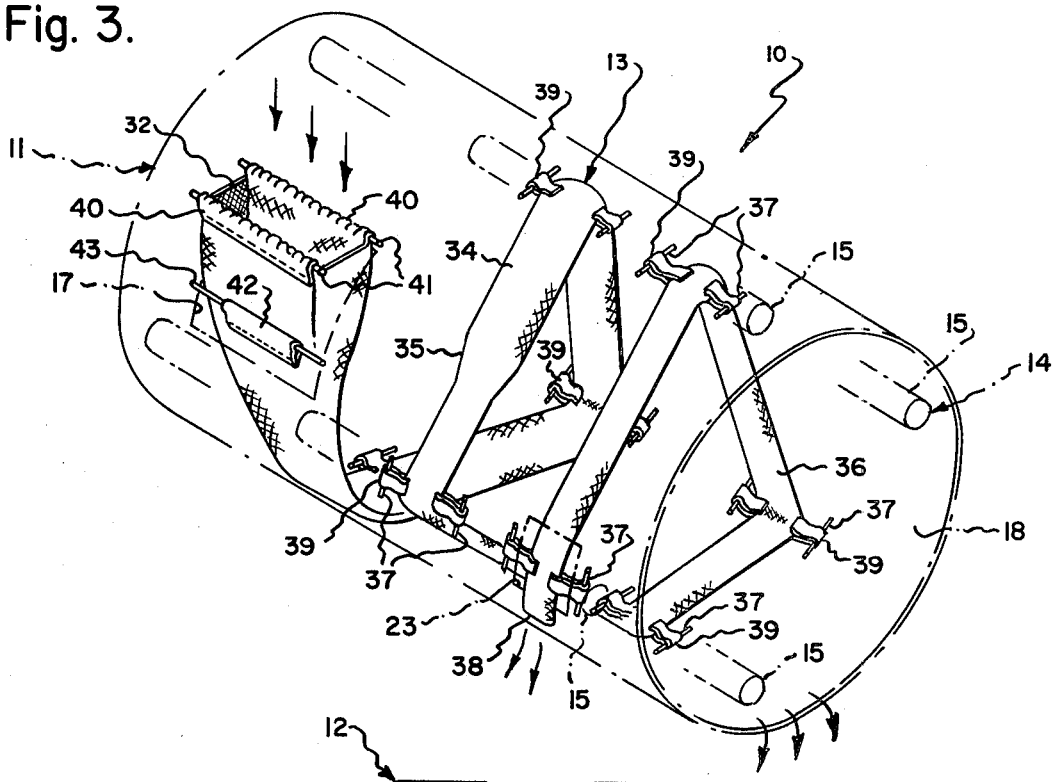
FIG. 3 is a view similar to FIG. 2 with the grinder and rotor removed and showing the bearing member in phantom to more clearly reveal the helical convolutions of the sleeve and the attachment of the sleeve to the bearing member.

At the outset, it should be clearly understood that like reference numerals are intended to identify the same elements and/or structure consistently throughout the several drawing figures, as such elements and/or structure may be further described or explained by the entire written specification of which this detailed description is an integral part.

The present invention provides an improved juice extractor which is adapted to separate the juice of a pomace from the pulp thereof. As used herein, a "pomace" is intended to mean the crushed pulp of a fruit or other plant from which the juice is to be extracted, the "juice" means the liquid part of such pomace, and the "pulp" is intended to refer to the soft moist solid mass of such pomace from which some juice has been extracted. While the present invention possesses particular utility in extracting juices from fruits, such as apples, pears, peaches, grapes and the like, the inventive extractor may be used to separate juices from other plant pomaces as well.

FIRST PREFERRED EMBODIMENT (FIGS. 1-11)

Referring initially to FIGS. 1-5, a first preferred embodiment of the improved juice extractor is generally indicated at 10.

This first embodiment is shown as broadly including a cylindrical bearing member or shell 11; a grinder 12 for comminuting fruit to a pomace; an elongated tubular foraminous sleeve 13 arranged within the bearing member; a rotor 14 arranged within the bearing member and having a plurality of roller members 15 adapted to press proximate portions of the sleeve against the bearing member; and drive means 16 operatively arranged to rotate the rotor to cause the roller members to move along the sleeve to advance the pulp and to cause the juice to be extracted from the pomace.

Figure 7:
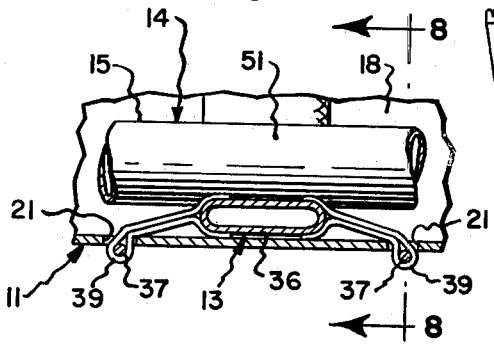
FIG. 7 is an enlarged fragmentary vertical longitudinal view thereof, taken generally on line 7—7 of FIG. 2, showing two tabs attached to an intermediate portion of the sleeve as passing through openings provided in the bearing member and held in this position by the retaining pins.
Figure 8:
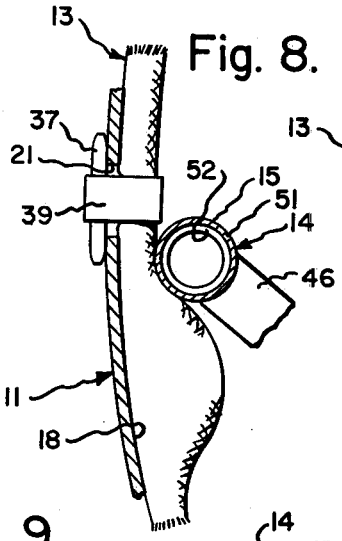
FIG. 8 is a fragmentary transverse vertical sectional view thereof, taken generally on line 8—8 of FIG. 7, this view showing the retaining pins as inserted in the tabs to hold the sleeve adjacent the bearing member, and also showing a roller member as pressing against the sleeve to advance the contents therealong.
Figure 9:
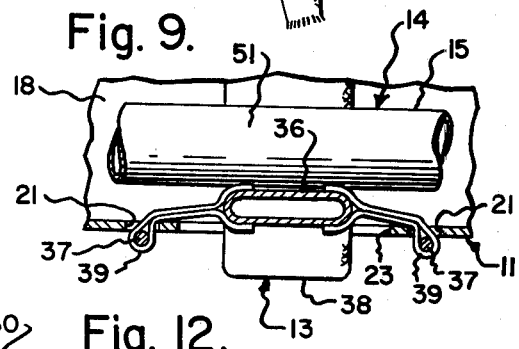
FIG. 9 is an enlarged fragmentary longitudinal vertical sectional view thereof, taken generally on line 9—9 of FIG. 2, showing the manner by which the sleeve is held adjacent the bearing member, and also showing a marginal portion of the sleeve adjacent its exit end as passing through the bearing member discharge opening.

The bearing member 11 is shown as being a thin-walled open-ended cylindrical shell or drum having its axis slightly inclined from the horizontal so that extracted juice will tend to flow downwardly along the bottom of its internal bearing surface 18 toward a collecting tank 19 (FIG. 2). This bearing member 11 is shown supported by four feet, severally indicated at 20, which are adapted to rest directly on the ground, or on some other support or foundation. This bearing member 11 is shown provided with sixteen slot-like openings, severally indicated at 21, which are arranged in rows of four each. As best shown in FIG. 4, these four rows are spaced circumferentially about the bearing member at intervals of about ninety degrees, and the slots in any given row are spaced axially from one another. As shown in FIGS. 7 and 8, these slots 21 are rectangular and elongated in the circumferential direction. The bearing member adjacent its front end is provided with an entrance opening, indicated at 17 in FIGS. 3 and 6, about which is mounted an entrance conduit 22, and adjacent its rear end is also provided with a discharge opening, indicated at 23 in FIGS. 3 and 9. At each end, the bearing member is provided with one or more diametrical cross members 24, 25 on which the rotor may be mounted, as hereinafter explained. In the preferred embodiment, the diameter of the bearing member is about thirty inches, and its length is about forty-eight inches.

Figure 6:
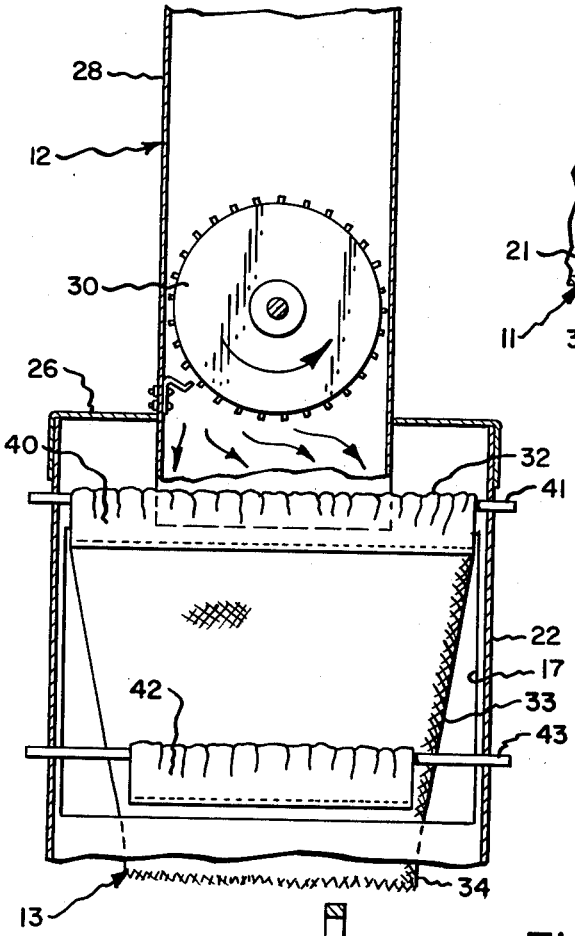
FIG. 6 is an enlarged fragmentary vertical longitudinal sectional view thereof, taken generally on line 6—6 of FIG. 4, this view showing the manner by which the entrance end of the sleeve is held open to receive juicy pomace delivered from the grinder.

Adverting now to FIGS. 1, 2 and 6, the grinder 12 is shown as being supported by a bracket 26 suitably affixed or secured to the bearing member. While any suitable type of grinder may be employed, the one shown includes a side wall structure 28 having a rectangular cross-section and adapted to receive fruit to be crushed, a toothed wheel or cylinder 30 arranged within this side wall structure, and a motor 31 arranged to rotate wheel 30. Thus, fruit deposited in grinder is crushed by the action of toothed wheel 30, and such comminuted fruit or pomace descends to enter the sleeve, as hereinafter described.

Figure 11:
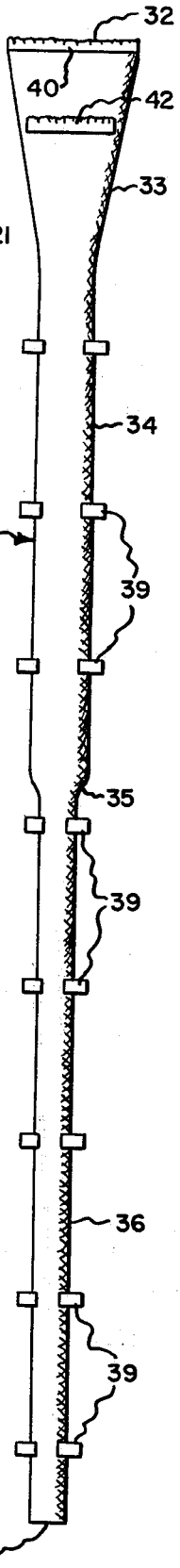
FIG. 11 is a detail view of the sleeve, this view showing its entrance end, its funnel portion, its large area cylindrical portion, its reducing neck, its small area cylindrical portion, and its exit end.

Referring now in particular to FIG. 11, the sleeve 13 is depicted as being an elongated open-ended flexible tubular member having an open upper entrance end 32, a funnel-shaped entrance portion 33 therebelow, a first cylindrical portion 34 having a relatively large cross-section, a reducing neck portion 35, and a second cylindrical portion 36 of a relatively small cross-section and continuing downwardly toward its lowermost exit end 38. The sleeve is constructed of a foraminous material which is permeable to the juice to be extracted, but is substantially impermeable to the solid pulp of such fruit. Also, the sleeve material preferably is relatively elastic in the transverse direction, but substantially inelastic to longitudinal elongation. Thus, a flow of crushed fruit entering this sleeve 13 through its entrance end 32 is compressed by the elasticity and decreasing cross-sectional area of the sleeve along its length. It has been found that satisfactory sleeve material is a cloth which is substantially fifty percent cotton, with the balance being dacron.

In lieu of the discrete stepped portions, the sleeve may alternatively have a continuous taper along all or part of its length, as desired. With such a tapered shape the sleeve may be formed of a suitable foraminous material which is flexible but relatively inelastic to elongation in either the transverse or longitudinal directions.

The degree of taper is that which would maintain a substantially constant compression on the pomace within the sleeve as it loses juice in traveling the length of the sleeve.

To facilitate the mounting of sleeve 13 within the bearing member, the sleeve is provided with sixteen tabs or loops, severally indicated at 39, which are arranged in eight longitudinally-spaced pairs. As best shown in FIGS. 7 and 8, these tabs 39 may be suitably sewn to the sleeve and are arranged to penetrate the bearing member slots 21 and be held in this position by means of retaining pins 37 passed through the loops and acting against the bearing member outer surface. In the preferred embodiment, the length of the sleeve 13 is about fourteen feet, and this length is consumed in about two helical convolutions within the bearing member. Since the sleeve is held to the bearing member at ninety degree intervals, the sleeve may appear to present a substantially square outline, when viewed from either end of the bearing member (FIGS. 4 and 5).

Figure 4:
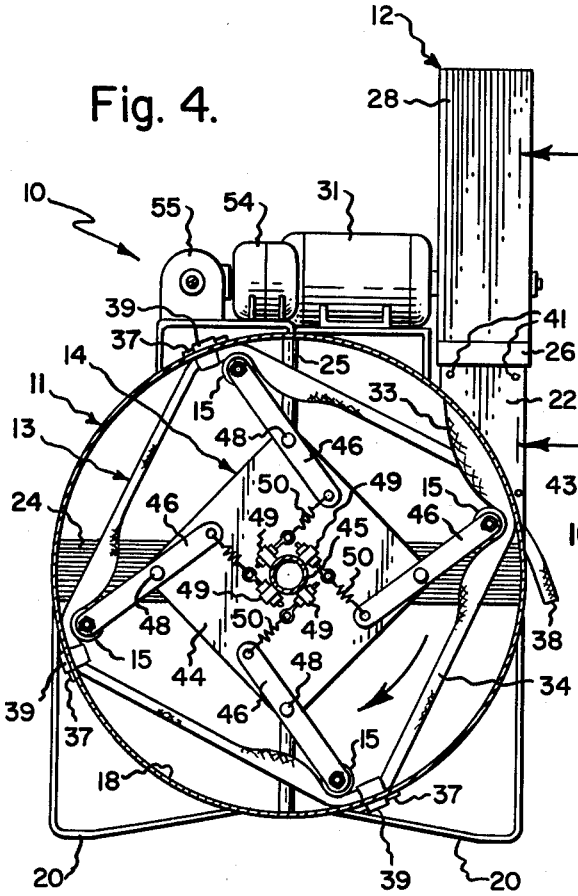
FIG. 4 is a fragmentary transverse vertical sectional view thereof, taken generally on line 4—4 of FIG. 1, and showing the orientation and biasing of the pivoted arms on the front rotor plate.

Referring now to FIGS. 3 and 6, the mouth of the sleeve is provided with a pair of spaced sewn tubes 40, 40 which extend longitudinally of cylindrical bearing member 11. Each such tube 40 accommodates the passage of a supporting rod 41 having its marginal end portions passing through openings provided in the front and rear walls of the entrance conduit 22. A third sewn tube 42 is provided on the outer side of the sleeve below and parallel to the outer tube 40 and receives a supporting rod 43 the ends of which pass through openings in entrance conduit 22. In this manner, the entrance end 32 of the sleeve is held in its open position and is adapted to receive fruit pomace delivered by the grinder 12.

Figure 5:
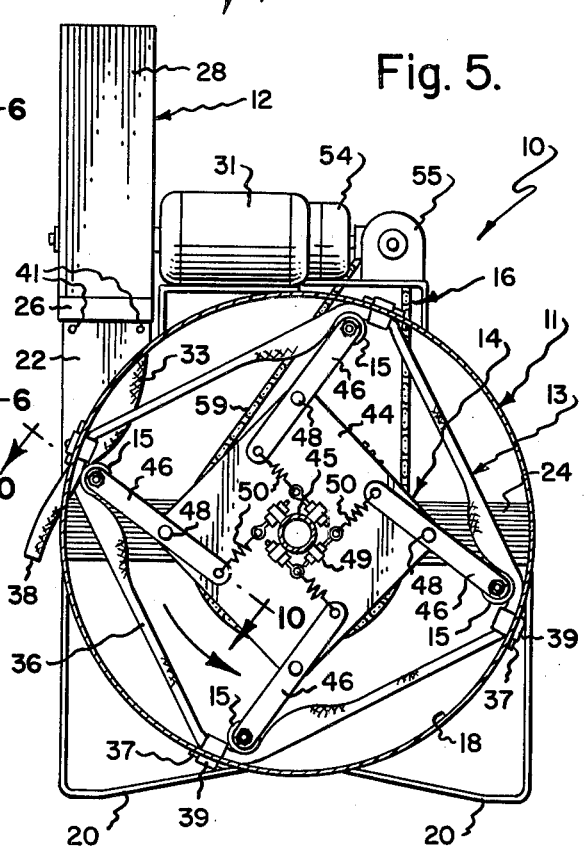
FIG. 5 is a fragmentary transverse vertical sectional view thereof, taken generally on line 5—5 of FIG. 2, and showing the orientation and biasing of the pivoted arms on the rear rotor plate.

Referring now principally to FIGS. 4 and 5, the rotor 14 is a specially configured member rotatably mounted within the bearing member. This rotor 14 is shown as including a pair of similarly oriented square substantially vertical plates 44 spaced axially from one another, non-rotatively fastened to a shaft 45 coincident with the axis of the bearing member and penetrating each plate at its center, and a plurality of intermediately pivoted arms 46 mounted on pivot pins 48 positioned adjacent the corners of each plate. The rotor further includes four adjustable anchors 49 spaced equally about the shaft proximate each plate, and a spring 50 engaging each anchor 49 and one end of an arm. These springs are arranged to urge the outer arm ends to pivot outwardly toward the bearing member. As best shown in FIGS. 1 and 2, the rotor shaft 45 is suitably journalled in the cross-members 24, 25, extending across the open ends of the bearing member.

Figure 10:
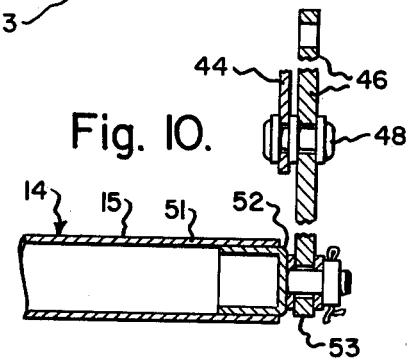
FIG. 10 is a fragmentary enlarged sectional view taken generally on line 10—10 of FIG. 5, this view showing the pivot pin and the manner in which the roller member is journalled on the arm.

Referring now to FIGS. 4, 5 and 10, the rotor is shown as supporting four roller members 15. These roller members 15 are freely-rotatably mounted on the outer ends of a cooperative pair of axially aligned arms 46, and are adapted to be biased by the action of springs 50 to move outwardly and press against proximate portions of the sleeve with a predetermined force. Thus, by adjusting anchors 49 to vary the tension of springs 50, the force with which the roller members engage the sleeve may be correspondingly varied. As best shown in FIG. 10, each roller member 15 may include an open-ended cylindrical pipe or tube 51, having a fitting 52 pressed into each end thereof and suitably journalled on an outboard end portion 53 of an arm. In this manner, each roller member 15 is freely rotatably mounted on the outboard ends 53 of a pair of parallel arms.

The drive means 16 is operatively arranged to rotate the rotor to cause the roller members to move relative to the sleeve to advance the pulp therealong and to cause the juice to be gently squeezed therefrom. As best shown in FIG. 1, this drive means 16 includes a motor 54, a reduction gear assembly 55 having a drive sprocket 56 fast to its output shaft, a driven sprocket 58 mounted fast to rotor shaft 45, and an endless flexible chain 59 operatively engaging sprockets 56 and 58. Hence, motor 54 may be operated to cause the rotor to rotate at an angular speed of about one revolution per minute.

In operation, fruit is supplied to the grinder which comminutes the same and causes the juicy pomace to enter the sleeve through its entrance end. The rotor is rotated by the drive means to cause the roller members to move relative to the tube. This motion gently squeezes the sleeve and causes its contents to be advanced therealong. This motion, coupled with the elasticity of the sleeve and its decreasing cross-sectional area, expresses the juice from the pulp along the length of the sleeve. The expressed juice passes through the sleeve and collects at the bottom of the bearing shell, from which it flows to the collecting tank. The pulp is discharged through the exit end of the sleeve.

When it is desired to clean or replace the sleeve 13, the various pins or rods supporting it on the drum are pulled to free it from attachment and allow it to be removed for suitable cleaning or replacement.

SECOND PREFERRED EMBODIMENT (FIG. 12)

Figure 12:
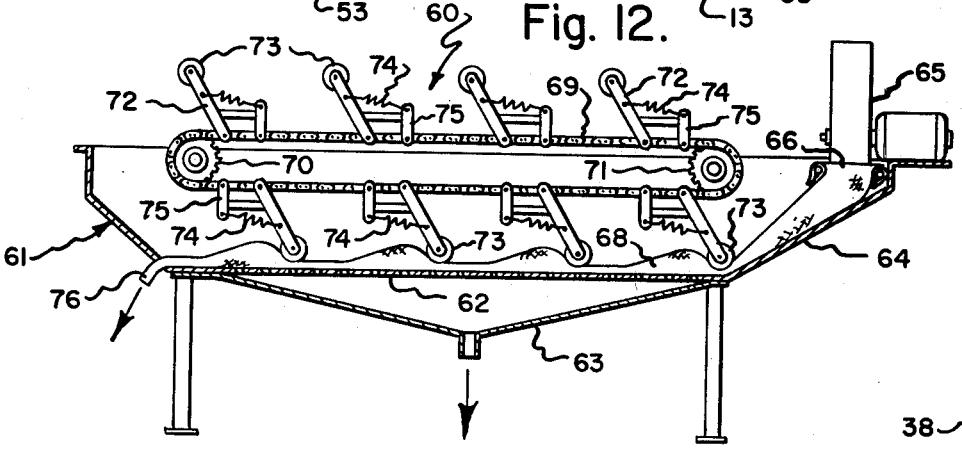
FIG. 12 is a schematic vertical sectional view taken longitudinally through a second preferred embodiment of the improved juice extractor, this view showing the table, the grinder, the linearly-positioned sleeve, and further showing the roller members as mounted on arms carried by an endless flexible chain.

In FIG. 12, a second preferred embodiment of the improved juice extractor is generally indicated at 60.

This second form is shown as comprising a table 61 having a bottom plate 62 provided with a plurality of holes or perforations, a hopper-like collecting basin 63 arranged immediately below perforated bottom plate 62, and a side wall structure 64. A grinder 65 is mounted on the table and is arranged to comminute fruit and to deliver such juicy fruit pomace to the entrance end 66 of a flexible foraminous sleeve 68.

An endless flexible chain 69 is operatively passed around two sprockets 70, 71, one of which is arranged to be rotated by a suitable drive means (not shown).

In this form, the arms, severally indicated at 72, have one marginal end portion pivotally mounted on the chain, and have freely-rotatable roller members 73 journalled on their other marginal ends. For each arm 72, a spring 74 at one end engages an anchor 75 mounted on the chain and at its other end engages the corresponding arm. Thus, as the chain is rotated, the several roller members are caused to bear against the sleeve with a force determined by the tension of the associated spring. Here again, the action of the moving roller members gently squeezes the sleeve and causes the contents thereof to be advanced toward its exit end 76. This second embodiment is disclosed to illustrate that the sleeve or sock may be arranged linearly, rather than wound within a cylindrical bearing member. Inasmuch as this second embodiment is illustrative of a modification, the foregoing description of same has been somewhat abbreviated. A more complete explanation of the various structure and materials may be found by resort to the first preferred embodiment.

In use, the improved juice extractors perform a novel method of separating the juice of a pomace from the pulp. This method comprises the steps of: supplying the pomace to the entrance end of an elongated open-ended sleeve constructed of a foraminous material which is permeable to the juice but substantially impermeable to the pulp, the cross-sectional area of this sleeve being smaller proximate its exit end than at its entrance end; holding the sleeve adjacent a bearing surface; pressing at least one rounded member against the sleeve to compress a proximate portion thereof between the member and the bearing surface; and moving the member along the sleeve to advance the contents thereof toward the exit end; thereby to cause the pomace to be gently squeezed to extract the juice therefrom while the pulp is advanced along the sleeve.

As presently noted, the sleeve is constructed of a foraminous material, such as a suitable cloth, which will be permeable to the particular juice to be extracted, while being substantially impermeable to the pulp. The sleeve should be flexible so that the roller members may cause the contents to be advanced along the sleeve. The flexibility of the sleeve material also tends to prevent the interstices thereof from becoming clogged with pulp. This action of the roller members on the sleeve, together with the decreasing cross-sectional area of the sleeve, and especially with a transversely elastic sleeve, imparts a gentle squeezing action to the pomace which separates the juice from the pulp. The ratio of the cross-sectional area of the sleeve at its entrance and exit ends may be about three to one as desired. Also, the sleeve is preferably constructed of a material which is elastic to elongation in the transverse direction.

Therefore, while two preferred embodiments of the inventive juice extractor have been shown and described, and several modifications thereof discussed, persons skilled in this art will appreciate that various additional changes and modifications may be made without departing from the spirit of the invention which is defined in the following claims.

What is claimed is:

1. In a juice extractor adapted to separate the juice of a pomace from the pulp thereof, the improvement comprising: a bearing member having a bearing surface; an elongated flexible sleeve positioned adjacent said bearing surface and formed of a foraminous material permeable to said juice but substantially impermeable to said pulp, said sleeve having an entrance end adapted to receive said pomace and having an exit end through which said pulp may be discharged; roller means mounted for movement relative to said sleeve and arranged to press a proximate portion of said sleeve against said bearing surface; and drive means coupled to said roller means for moving said roller means lengthwise along said sleeve for causing said roller means to squeeze juice from said pomace through said sleeve and for causing said roller means to advance said pomace from said entrance end toward said exit end.

2. The improvement as set forth in claim 1 wherein said drive means includes a rotor, an arm pivotally mounted on said rotor, and spring means arranged to act between said arm and rotor to bias said arm to move in one angular direction about its pivotal axis, and wherein said roller member is journalled on said arm.

3. The improvement as set forth in claim 1 wherein the cross-section of said sleeve is smaller proximate said exit end than it is proximate said entrance end.

4. The improvement as set forth in claim 1 wherein said flexible member has a funnel section proximate said entrance end.

5. The improvement as set forth in claim 1 wherein said flexible member is composed of a material substantially 50% cotton and 50% dacron.

6. The improvement as set forth in claim 1 wherein said bearing surface is substantially planar and is provided with a plurality of openings through which said juice may pass.

7. The improvement as set forth in claim 1 wherein said bearing surface is substantially cylindrical, and wherein the axis of said bearing surface is inclined with respect to the horizontal so that extracted juice may flow toward one end thereof.

8. The improvement as set forth in claim 1 wherein said bearing member is provided with at least one slot, and wherein said sleeve is provided with at least one tab arranged to pass through said slot and be retained in this position to hold said sleeve to said bearing member.

9. The improvement as set forth in claim 1 wherein said sleeve is elastic in a transverse direction but substantially inelastic in a longitudinal direction.

10. The improvement set forth in claim 1 wherein said bearing member comprises an elongated cylindrical shell, and wherein said elongated flexible sleeve extends in generally contiguous relationship to said bearing surface in convolution form, and wherein said drive means includes rotor means journalled for rotation relative to said shell for mounting said roller means.

11. The improvement set forth in claim 10 wherein said roller means comprises a plurality of rollers mounted on said rotor means.

* * * * *